United States Patent [19]

Scouten et al.

[11] 4,000,466

[45] Dec. 28, 1976

[54] APPARATUS FOR TIME-INTERVAL MEASUREMENT

[75] Inventors: Donald C. Scouten, Boone; David T. Stephenson, Ames, both of Iowa

[73] Assignee: Iowa State University Research Foundation, Inc., Ames, Iowa

[22] Filed: May 22, 1975

[21] Appl. No.: 579,875

[52] U.S. Cl. ..... 324/181; 328/133; 343/112 S

[51] Int. Cl.[2] ..... G04F 8/00

[58] Field of Search ..... 324/83 R, 83 D, 102, 324/178, 140 R, 140 D; 328/5, 133, 223; 307/232, 234, 295; 343/112 S

[56] References Cited

UNITED STATES PATENTS

| | | | |
|---|---|---|---|
| 2,975,275 | 3/1961 | Adams | 328/133 |
| 3,004,219 | 10/1961 | Albert | 343/112 S |
| 3,048,782 | 8/1962 | Altman | 328/133 |

*Primary Examiner*—Robert Segal
*Assistant Examiner*—Michael J. Tokar
*Attorney, Agent, or Firm*—Tilton, Fallon, Lungmus, Chestnut & Hill

[57] ABSTRACT

Apparatus is described for measuring the time interval between the occurrences of an electrical signal at two different points in a circuit or electrical system. Each signal drives a receiver containing a high-Q coaxial resonator. The resonators begin to oscillate in timed relation with the reception of the associated signals. Each receiver signal is mixed with the output signal of a common local oscillator and the respective mixed signals are amplified by IF amplifiers. The phase difference between the output signals of the IF amplifiers is representative of the difference in time of reception of the signals, but on an expanded time scale. The phase difference is detected and used to gate the output signal of an oscillator into a counter circuit. Thus, the accumulated contents of the counter is representative of the time difference of reception. Circuitry is also provided for indicating the polarity of the phase shift.

5 Claims, 5 Drawing Figures

RECEIVER 73.6 MHZ
RECEIVER 73.6 MHZ
IF AMP. AND COMPARATOR
IF AMP. AND COMPARATOR
LOCAL OSCILLATOR 72.864 MHZ
EXCLUSIVE "OR" GATE
"SELECT ONE" PULSE CIRCUITRY
AND GATE
DIGITAL COUNTER CIRCUIT
TIME MARK OSCILLATOR

AMPLIFIER
BUFFER AMPLIFIER

FROM EXCLUSIVE "OR" GATE
MONOSTABLE CIRCUIT
AND GATE
AND GATE
AND GATE
TO ENABLE
IF1 IF2

TIME

TIME
IF1
IF2
IF1 FIRST
IF2 FIRST

APPARATUS FOR TIME-INTERVAL MEASUREMENT

The U.S. Government has rights in this invention in accordance with National Science Foundation grant GU 3373.

BACKGROUND AND SUMMARY

The present invention relates to a system for measuring very minute time differences--of the order of microseconds or less--between the occurrences of an electrical signal at two spaced points in a system. A problem of this sort might occur, for example, in the measurement of the time difference in reception of an electromagnetic wave at two spaced, fixed antenna locations.

Such a technique is useful in a direction finder for sferics. A sferic is a transient electromagnetic wave caused by an atmospheric disturbance. The electromagnetic wave is detected by an antenna at each location. By using three or more antennas at known locations (such as to form two baselines at a non-zero angle to each other) two angles of incidence (azimuth and elevation), of the sferic wave upon the receiving location may be calculated from the time difference measurements. Such an instrument can provide information about the discharge processes within a storm.

The present invention will be illustrated with two received signals, but the method and apparatus disclosed can easily be extended to include three or more received signals if desired.

Briefly, prior time-interval measurement systems have required very wide bandwidths (a disadvantage when the signals arrive through antennas in the presence of interfering signals) and expensive and complicated circuitry and components for measuring very small intervals (of the order of 10 to 100 nanoseconds) directly with high resolution.

Each receiver in the present invention is provided with a coaxial resonator for converting an incident transient signal to a damped sinusoid so that the advantages of phase techniques may be exploited. The resonators are carefully matched in frequency and "Q" (quality factor or damping coefficient) so that their outputs remain phase-stable over several hundred cycles of the lightly-damped sinusoidal output. One of the advantages of using coaxial resonators is that this matching can be obtained.

The resonators, upon reception of a transient signal, begin to oscillate in timed relation with the reception of the received signal. Each resonator output signal is mixed with the output signal of a common local oscillator; the respective mixed signals are amplified by intermediate frequency (IF) amplifiers.

The phase difference of the output signals if the IF amplifiers is representative of the difference in time of reception of the signals at the two locations, but on an expanded time scale. With the present system, for example, a time scale magnification of 100 is easily accomplished.

The phase difference between the two signals in the IF amplifiers is detected and used to gate the output signal of a time mark oscillator into a counter circuit. Thus, the accumulated contents of the counter is representative of the time difference of reception. Circuitry is also provided for indicating the polarity of the phase shift (i.e., whether the phase shift is leading or lagging.)

The present invention thus provides a very accurate and reliable system for measuring very small time differences between received signals. Other features and advantages of the present invention will be apparent to persons skilled in the art from the following detailed description of a preferred embodiment accompanied by the attached drawing.

THE DRAWING

DETAILED DESCRIPTION

Figures 1, 2, 3, 4, 5:
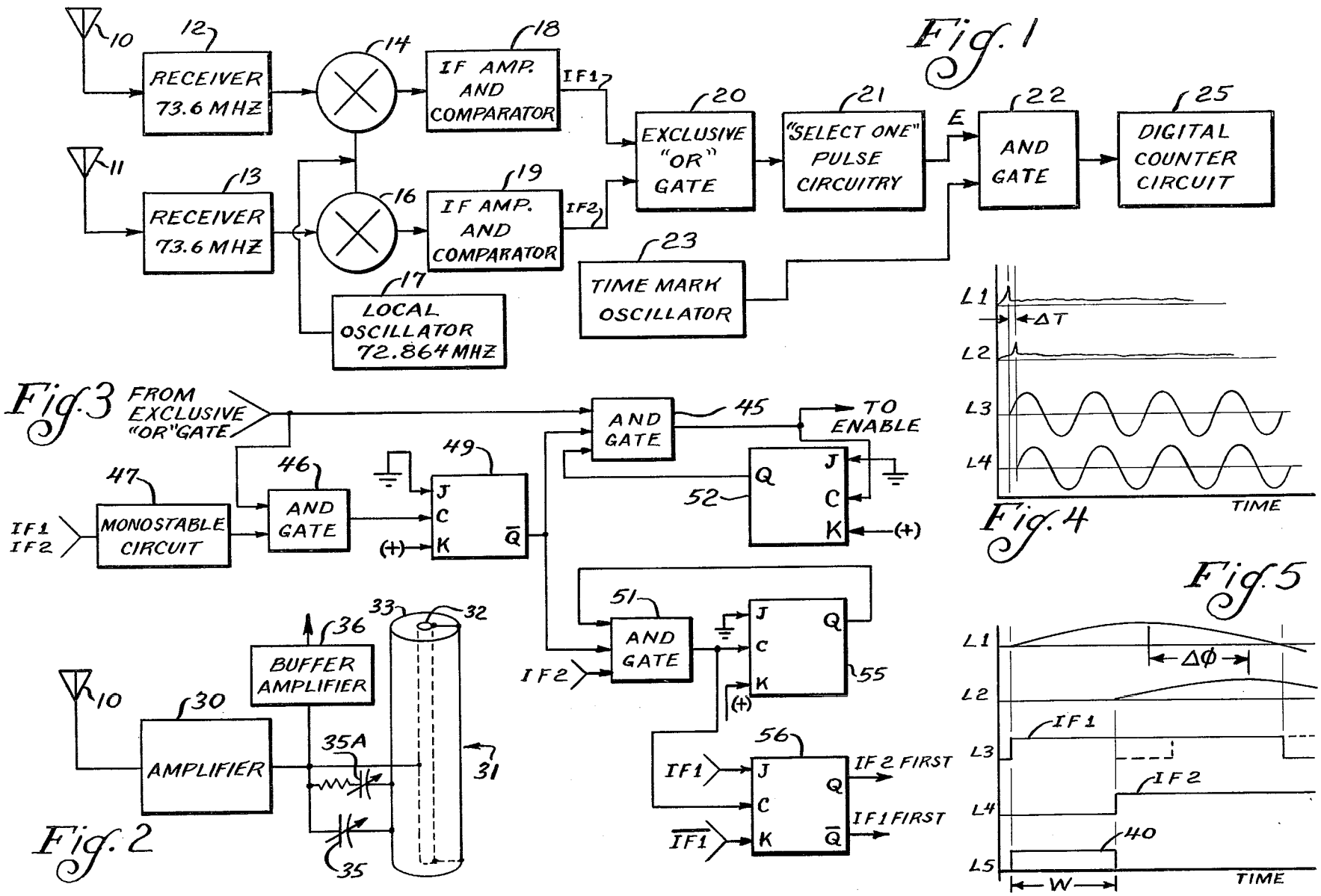
FIG. 1 is a functional block diagram of a system incorporating the present invention.
FIG. 2 is a circuit schematic diagram of a receiver using a coaxial resonator.
FIG. 3 is a logic circuit diagram for the "SELECT ONE" circuitry of FIG. 1.
FIG. 4 is a graph of idealized waveforms illustrating the operation of the analog wave portion of the system of FIG. 1.
FIG. 5 is a graph of idealized waveforms illustrating the phase relations and digital portions of the system.

Referring first to FIG. 1, reference numerals 10 and 11 indicate a pair of antennas which are located at known, fixed positions. A pair of receivers 12, 13 are coupled respectively to the antennas 10, 11. The receivers 12, 13 are of the same design, to be discussed, and they operate at the same frequency. In the illustrated embodiment, the receivers 12, 13 operate at 73.6 MHz.

First and second mixer circuits 14, 16 receive the output signals of the receivers 12, 13 respectively, and these signals are mixed with the output signal of a local oscillator 17, operating in the illustrated embodiment at 72.864 MHz.

The output signals of each of the mixers 14, 16 is coupled to an associated IF amplifier and comparator, designated 18 and 19, respectively. The IF amplifiers and comparators include conventional designs for the IF amplifiers, the outputs of which feed a comparator circuit whose negative input is referenced to zero voltage. Hence, the output of the comparators is a square wave for a sinusoidal input. The outputs of the comparators 18, 19 are labeled respectively IF1 and IF2; and they are fed to the inputs of an EXCLUSIVE OR circuit which, again, may be a conventional design. An EXCLUSIVE OR gate is one which generates a high logic level when either one or the other, but not both of the input signals is at a high logic level. The EXCLUSIVE OR gate is designated 20 in FIG. 1, and its output is coupled to a "SELECT ONE" pulse circuit 21 which will be described more fully below. The output of the "SELECT ONE" pulse circuit 21 is connected to one input of an "AND" gate 22, this input being designated the ENABLE input, the other input of which is driven from a time mark oscillator 23. The oscillator 23 may be operating at a frequency of 188.416 MHz., which will yield 256 pulses for each cycle of the operating frequency of the IF amplifiers 18, 19, although this is not necessary. When the ENABLE lead of the AND gate 22 is actuated, the output of the time mark oscillator 23 is coupled through the AND gate 22 to a digital counter circuit 25 which counts the pulses from the oscillator 23.

Before turning to the operation of the system of FIG. 1, reference is made to FIG. 2 wherein there is shown a more detailed functional diagram of the receivers 12, 13. An input amplifier 30 receives the signal from the antenna, and is coupled to a coaxial resonator generally designated 31. The amplifier 30 may comprise two sections, an input voltage amplifier section for signal to noise improvement, followed by an output current amplifier section for high output impedance. By way of example, the voltage amplifier may be a broad band amplifier of the type used for cable television, such as that which is sold under the designation No. 417 by Amperex Corporation. The current amplifier or controlled current source may be that commercially available under the designation HEP590 by Motorola Corporation. The coaxial resonator 31 is a transmission line including a center conductor 32 and an outer conductor 33. Both ends of the line are shortcircuited. The length of the line defines a natural resonant frequency, and being a resonant circuit, it presents a high impedance to the output of the amplifier 30 at resonance. The center conductor 32 may be a copper pipe having a 0.625 inch outer diameter, and the outer conductor 33 may be a copper pipe having a 1½ inch inner diameter. Two variable capacitors 35 and 35A may be used to adjust the resonant frequency and the damping factor of the resonator. The output signal is coupled through a buffer amplifier 36 to the mixer. The buffer amplifier 36 may be a field effect transistor connected in a source follower configuration so as to provide a high input impedance and not load the coaxial resonator.

The use of a coaxial resonator of the type described in the receivers 12, 13 provides the stability necessary to generate phase stable pseudo-sinusoidal (i.e., slightly damped) waveforms from pulse-type input signals. This is important because it is necessary that the receivers 12, 13 operate at the same frequency. If the two receivers do not operate the same frequency, there is an inherent inaccuracy in measuring the time difference of arrival of a pulse at the antennas 10, 11. Obviously, a substantial difference in lead length between the antennas and their associated receivers should be taken into account.

The response of a first receiver to an impulse is of the form $$y_1 = KU(t)e^{-\zeta\omega_n t}\sin\omega_r t$$

where K is related to signal strength and receiver gain $U(t) = 0$ for $0 > t$; 1 for $0 < t$ $\zeta$ = damping constant of coaxial resonator $\omega_r = \omega_n \sqrt{1-\zeta^2}$ The output from a similar receiver excited by a similar pulse delayed by a time interval $\Delta t$ would be $$y_2 = U(t-\Delta t(Ke^{-\zeta\omega_n(t-\Delta t)}\sin\omega_r(t-\Delta t)$$

If the outputs from these receivers are then mixed with a common local oscillator at frequency $\omega_L$ in a superhetrodyne fashion, there is formed an IF waveform of that form:

$$v_1 = y_1 \sin\omega_L t = \tfrac{1}{2} KU(t)e^{-\zeta\omega_n t}\cos(\omega_r-\omega_L)t$$
$$v_2 = y_2 \sin\omega_L t = \tfrac{1}{2} KU(t-\Delta t)e^{-\zeta\omega_n t}\cos[(\omega_r-\omega_L)t - \omega_r\Delta t]$$

The higher frequency $(\omega_r+\omega_L)$ component has been eliminated from the equations since it can be filtered out. The time difference between zero crossings of $v_1$ and $v_2$ is $\omega_r/(\omega_r-\omega_L)\ \Delta t$ and is thus expanded by the factor $\omega_r/(\omega_r-\omega_L)$ compared with the original $\Delta t$ time difference. This expansion in time interval represents an equivalent improvement in the resolution of a scaler measuring time difference.

OPERATION

The operation of the system of FIG. 1 will be explained with further reference to FIGS. 4 and 5 which show various voltages appearing in the system. Assuming that an electromagnetic impulse is received first at the antenna 10, the output signal of the antenna 10 is illustrated on line L1 of FIG. 4. Shortly after the reception of the signal at the antenna 10, the pulse is received at the antenna 11, and the resulting signal is shown at line L2 of FIG. 4—that is, slightly delayed in time relative to the pulse on line L1.

The sinusoidal output signal of the receiver 12 is shown on line L3 of FIG. 4. This signal is a decaying sine wave, and it has a fixed time relationship with the received impulse on line L1. Similarly, the output signal of receiver 13 (line L4 of FIG. 4) is generated in response to the reception of the pulse at the antenna 11 and bears a fixed time relation with respect to the occurrence of the pulse on line L2. The phase difference between the sine waves at L3 and L4 is a function of the time difference $\Delta T$ between the reception of the same impulse at the two antennas 10, 11.

The output of the receivers 12, 13 are fed to the mixers 14, 16 respectively where they are multiplied with the output signal of a common local oscillator 17. By mixing the output signals of the receivers with a common local oscillator, the phase relationship between the two mixer outputs will be the same as the phase relationship between the two receiver outputs. The mixer outputs are coupled to the IF amplifiers 18, 19 whose signals are shown respectively on lines L1 and L2 of FIG. 5. It will be observed that the small time difference between the received signals has been magnified to a large time difference ($\Delta\Phi$) between corresponding IF signals. Thus, the same phase shift represents a significant expansion or magnification of the time delay between the waveforms at the outputs of the IF amplifiers. Specifically, for the case illustrated, the sine wave of line L2 (FIG. 5) is delayed relative to that on line L1 thereof by a factor equal to $$\frac{\omega_r}{\omega_r-\omega_L}\Delta T$$

where $\omega_r$ is the resonant frequency of the coaxial resonator 31, and $\omega_L$ is the frequency of the local oscillator 17. For this example, with the frequencies indicated above, the time scale is expanded by a factor of 100.

The time interval between the outputs of the IF amplifiers can be measured by detecting the zero crossings of the IF output and measuring the time difference between the corresponding zero crossings of the two outputs. Thus, very small time differences at the antennas can be expanded by a relatively large factor so that they can be measured with conventional scalers at the IF output.

In the illustrated embodiment, the IF outputs are coupled through respective comparators so as to generate corresponding square waves such as those seen in lines L3 and L4 of FIG. 5, respectively representing the outputs IF1 and IF2.

When the two waveforms IF1 and IF2 of lines L3 and L4 of FIG. 5 are fed to the EXCLUSIVE OR gate 20, the resultant output is shown in line L5, where the width, W, of the pulse 40 is a measure of the phase difference between the sinusoidal outputs of the IF amplifiers. Hence, the time width of the pulse 40 is a measure of the time difference between the arrival of the electromagnetic wave at the two antennas. This pulse is then fed into "SELECT ONE" pulse circuitry 21 which selects only one of the incident pulses and uses the selected pulse to enable an AND gate 22 to gate the output of a time mark oscillator 23 into a counter circuit 25. The contents of the counter circuit comprise digital signals representative of the width of the pulse 40, and hence it is a measure of the original time difference $\Delta T$.

Referring now to FIG. 3, in addition to the "SELECT ONE" pulse circuitry, there is shown circuitry for indicating at which antenna the sferic was first received. The output from the EXCLUSIVE OR gate 20 is connected to one input of a three-input AND gate 45 and to one input of the two-input AND gate 46. The other input of the AND gate 46 is received from a conventional monostable circuit 47 which is designed to generate an output pulse of approximately 10 microseconds. The monostable circuit 47 is triggered by a "Start Measurement" indication which may be of the first-occurring of the signals IF1 or IF2. The output of the AND gate 46 is coupled to the clock input (C) of a negative edge triggered J-K flip-flop 49. The $\overline{Q}$ output of the flip-flop 49 is connected to the second input of an AND gate 45 and to an input of another three-input AND gate 41. The output of the AND gate 45 is the signal which enables the AND gate 22 of FIG. 1, and this signal is also coupled to the clock input of a J-K flip-flop 52, the Q output of which is connected as the third input of the AND gate 45. Both of the flip-flops 49, 52 have their J inputs grounded (a logical "0") and their K inputs connected to positive voltage or logical "1", as illustrated. Flip-flops 52, 55 and 56 are clocked with negative slopes of input levels.

The output of the AND gate 51 is connected to the clock input of another J-K flip-flop 55, having its Q output coupled as the second input of the AND gate 51. The J and K inputs of the flip-flop 55 are connected the same as for the flip-flop 52. The third input of the AND gate 51 is the signal IF2.

The output of the AND gate 51 is also connected to the clock input of a J-K flip-flop 56. The J input of the flip-flop 56 is the signal IF1 and the K input is the signal $\overline{IF1}$. The Q output of the flip-flop 56, when generating a logical "1" indicates that the signal IF2 occurred first. If the $\overline{Q}$ output is a logical "1", it indicates that the signal IF1 occurred first, as will be explained presently. All of the flip-flops 49, 52, 55 are reset prior to a measurement cycle. The reset may be provided either manually or electronically.

In operation, the circuitry of FIG. 3 receives a pulse, such as the pulse 40 on line L5 of FIG. 5 from the EXCLUSIVE OR gate 20. At the first occurrence of either IF1 or IF2, the monostable circuit 47 had been actuated to enable the AND gate 46. Hence, the pulse 40 is coupled through the AND gate 46 to clock the flip-flop 49, thereby causing the $\overline{Q}$ output to become a "1". The Q output of flip-flop 52 already is "1" (due to reset), so the AND gate 45 is enabled, thereby enabling AND gate 22 to transmit oscillator pulses to the counter circuit. The AND gate 45 remains enabled as long as the output from the exclusive OR gate 22 remains a "1". When it goes negative, the flip-flop 52 is clocked and the AND gate 45 thereafter becomes disabled. Hence, only a single pulse from the EXCLUSIVE OR gate 20 is selected.

When the $\overline{Q}$ output of flip-flop 59 becomes a "1", it enables the AND gate 51. It will be appreciated that the Q output of the flip-flop 55 had already been a "1" due to reset.

At a negative edge of the IF2 signal, AND gate 51 generates a negative edge to trigger the clock input of the flip-flop 55. The Q output of flip-flop 55 thereupon goes negative to disable the AND gate 51.

The output of the AND gate 51 is also coupled to the clock input of the flip-flop 56. It will be appreciated that the output of the AND gate 51 goes positive only when the signal IF2 goes positive, hence it is a reproduction of the IF2 signal. When the IF2 signal goes negative, the Q output of the flip-flop 56 will go positive only if the signal IF1 is positive, thereby indicating that the signal IF2 leads signal IF1. In other words, referring to lines L3 and L4 of FIG. 5, if the signal IF2 occurs first, then the signal IF1, (as represented by the dashed line in line L3) will be a "1" when IF2 goes negative, and the Q output of flip-flop 56 will be positive. If, on the other hand, as shown by the solid line in L3, IF1 occurs first, then the signal $\overline{IF1}$ will be a "1" and IF2 goes negative, and the ouput $\overline{Q}$ will go positive. Thus, the output of the flip-flop 56 is representative of whether the phase shift between IF1 and IF2 is leading or lagging.

Having thus described one embodiment of the inventive system, persons skilled in the art will be able to modify certain of the circuitry which has been disclosed and to substitute equivalent elements or circuits for those illustrated while continuing to practice the principle of the invention; and it is, therefore, intended that all such modifications and substitutions be covered as they are embraced within the spirit and scope of the appended claims.

We claim:

1. Apparatus for measuring the time difference of occurrence of an electrical impulse or transient signal between two fixed locations separated by a known distance comprising: first and second receiver means coupled respectively to said locations, each receiver means including resonant circuit means responsive to the signal received at said locations respectively for generating generally sinusoidal waveforms in response to reception of the signals, the phase of oscillation being representative of the time of occurrence of said electrical impulse or transient signal at the respective locations; local oscillator circuit means; first mixer circuit means for mixing the output signal of said local oscillator with the sinusoidal signal of said first receiver means; second mixer circuit means for mixing the output signal of said local oscillator with the sinusoidal signal of said second receiver means; first IF amplifier means receiving the output signal of said first mixer circuit means for generating a continuous wave signal in response thereto; second IF amplifier means receiving the output signal of said second mixer circuit means for generating a continuous wave signal in response thereto; and output circuit means responsive to the output signals of said first and second IF amplifier means for generating a signal representative of the phase difference therebetween, said signal being further representative of the time difference of occurrence of said impulse or transient signal at said two spaced locations.

2. The system of claim 1 wherein each of said receiver means includes an antenna; an input amplifier; and wherein each of said resonant circuit means comprises a coaxial resonator excited by its associated amplifier.

3. The apparatus of claim 2 wherein said first and second IF amplifier means each includes a comparator circuit for generating a square wave in timed relation with the continuous wave of its associated IF amplifier means.

4. The apparatus of claim 3 wherein said output circuit means comprises exclusive OR gate means receiving the output signals of said first and second comparator circuit means for generating an output signal occurring only when both of said comparator signals are present; SELECT ONE pulse circuit means for selecting only one of the pulses of said exclusive OR gate means to generate an ENABLE signal; time mark oscillator circuit means for generating a continuous train of periodic pulses, digital counter circuit means; and AND gate means responsive to said ENABLE signal for gating the output signal of said time mark oscillator circuit means to said counter circuit means, the contents of said counter circuit means being representative of the time difference of reception of said electromagnetic wave at said first and second antennas.

5. The system of claim 1 further comprising circuit means for generating an output signal representative of the location of first occurrence of said electromagnetic wave.

* * * * *